United States Patent [19]

Jouillat

[11] Patent Number: 4,984,712

[45] Date of Patent: Jan. 15, 1991

[54] DISPENSER FOR A LIQUID OR A PASTE PUT UNDER PRESSURE BY PRIOR DEFORMATION OF A RESILIENT RECEPTACLE

[75] Inventor: Claude Jouillat, Montigny sur Avre, France

[73] Assignee: S.T.E.P., Avre, France

[21] Appl. No.: 293,915

[22] Filed: Jan. 6, 1989

[30] Foreign Application Priority Data

Jan. 8, 1988 [FR] France ..... 88 00122

[51] Int. Cl.[5] ..... B65B 3/16

[52] U.S. Cl. ..... 222/95; 222/107; 141/21; 141/114

[58] Field of Search ..... 141/21, 24–26, 141/114, 119, 369, 375, 2; 222/92, 94–95, 96, 107, 206–207, 212–215, 378, 380, 383, 518, 105

[56] References Cited

U.S. PATENT DOCUMENTS

| | | | |
|---|---|---|---|
| 3,698,595 | 10/1972 | Gortz et al. | 222/386.5 X |
| 4,217,994 | 8/1980 | Koenig et al. | 222/212 |
| 4,386,929 | 6/1983 | Peery et al. | 604/132 |
| 4,692,151 | 9/1987 | Blackman | 604/132 |
| 4,789,082 | 12/1988 | Sampson | 222/1 |

FOREIGN PATENT DOCUMENTS

| | | |
|---|---|---|
| 248755 | 12/1987 | European Pat. Off. . |
| 2305241 | 10/1976 | France . |

*Primary Examiner*—Michael S. Huppert
*Attorney, Agent, or Firm*—Sughrue, Mion, Zinn, Macpeak & Seas

[57] ABSTRACT

It is advantageous for a substance in the form of a liquid or a paste to be packaged under pressure and in the absence of any air inside a receptacle (1) which is hermetically closed by a valve (2) for the purpose of dispensing the substance. A convenient way of putting the substance under pressure therefore consists in using a resilient receptacle (1) which is prior deformed so that its walls (10) seek to return to their natural shape (in dashed lines) and exert a force on the substance. The present invention uses mechanical means for imparting said deformation. As a result, the receptacle (1) can be filled with substance at atmospheric pressure. The receptacle is constituted by a single envelope whose shape is of an appearance suitable for the market for this type of dispenser and is adapted to easy manipulation in the hand. Finally, if the dispenser is provided with a precompression pump type valve (2) up to 95% of the substance initially contained in the receptacle (1) can be dispensed.

9 Claims, 3 Drawing Sheets

DISPENSER FOR A LIQUID OR A PASTE PUT UNDER PRESSURE BY PRIOR DEFORMATION OF A RESILIENT RECEPTACLE

The present invention relates to a dispenser for a liquid or a paste, the dispenser being constituted by a deformable receptacle which is hermetically closed by a valve. The elasticity of the receptacle is used to put the substance to be dispensed under pressure.

BACKGROUND OF THE INVENTION

One example of a distributor of this type is described in European patent application EP-0 248 755. Its receptacle includes a tube which is sufficiently flexible to expand very considerably when filled with a substance under pressure. As soon as a valve has been crimped in completely airtight manner on the tube, the pressure exerted on the substance by the tube is comparable to the filling pressure, with the resilient walls of the tube seeking to return to their original shape. As successive quantities of substance are dispensed, the internal pressure drops until the tube is no longer deformed. In order to implement this principle in practical manner, the flexible tube is additionally protected by a rigid external container which makes the dispenser easier to handle. A foam is advantageously disposed between the flexible tube and the rigid container in order to hold the various different envelopes of the receptacle in place within the dispenser.

The present invention retains the idea of prior deformation of a resilient receptacle for the purpose of putting the substance to be dispensed under pressure. However, it seeks to implement this principle in a manner which is simpler than that of the prior art. In particular, it is desirable for reasons of economy for the receptacle to be constituted by a single envelope.

SUMMARY OF THE INVENTION

Thus, the present invention provides a dispenser for a substance in the form of a liquid or a paste and put under pressure by prior deformation of a resilient receptacle, said receptacle being closed by a valve suitable for ensuring that air cannot penetrate into the receptacle at any stage, with the inside volume of said receptacle varying as a function of its state of deformation, wherein said resilient receptacle is designed so as to be suitable for being deformed by mechanical means. Particularly advantageously, said valve is a precompression pump valve. In addition, for example, said mechanical means are constituted by an undeformable part including a hollow for receiving said receptacle while constraining it to deform in such a manner as to increase its inside volume.

In a first embodiment of the present invention, said resilient receptacle is a flat tube having two flexible faces, two sides, and a bottom, said sides and said bottom being interconnected by corners, said receptacle further including a neck, said sides, said bottom, and said corners being reinforced, and said neck being constituted by a rigid base surmounted by a bottleneck per se. For example, an envelope constituting said faces, said sides, said bottom, and said corners is welded to said base of said neck. In such cases, it is advantageous for said corners of said flat tube to be rounded in order to facilitate insertion of said tube into said hollow of said undeformable part constituting said mechanical means. In this case, said hollow of said undeformable part constituting said mechanical means is a cylinder of elliptical section, with the long axis of said elliptical section being shorter than the distance between said sides of said tube when said tube is a t rest.

In a second embodiment of the present invention, said resilient receptacle is a cylindrical flask having an elongate neck, an ovoid body, and a bottom, said ovoid body having flexible faces interconnected by a reinforced edge, with said neck and said bottom being rigid. In this case, said hollow in said undeformable part constituting said mechanical means is a cylinder of circular section, with the diameter of said section being less than the diameter of said edge of said flask when said flask is at rest.

It is particularly easy to manufacture said receptacle out of molded plastic material.

In addition to the advantage of being constituted by a single envelope, a dispenser in accordance with the invention does not need substance to be injected into it under pressure. The dispenser can be filled at atmospheric pressure, thereby considerably simplifying both the filling operation and the operation of crimping on the valve.

Further, the substance is protected from the air at all times and therefore does not run the risk of being oxidized or contaminated. This absence of air also means that there is no need for a dip tube since the inside of the receptacle contains nothing but the substance to be dispensed. As a result the substance can be dispensed while the dispenser in any position relative to the vertical.

BRIEF DESCRIPTION OF THE DRAWINGS

Two embodiments of the invention are described by way of example with reference to the accompanying drawings, in which:

FIG. 1 is a front view in partial longitudinal section, FIG. 2 is a side view in partial section on plane I—I of FIG. 1, FIG. 3 is a plan view, and FIG. 4 is a plan cross-section on plane III—III of FIG. 2.

FIGS. 9 and 10 are respectively a front view and a cross-section on plane III—III, and FIG. 11 is a side view.

FIG. 12 is a plan view and FIG. 13 is a front view of the flask immediately after it has been manufactured. FIG. 14 is a front view showing the flask while it is being filled, and FIG. 15 shows the flask after it has been emptied.

MORE DETAILED DESCRIPTION

Figure 1:
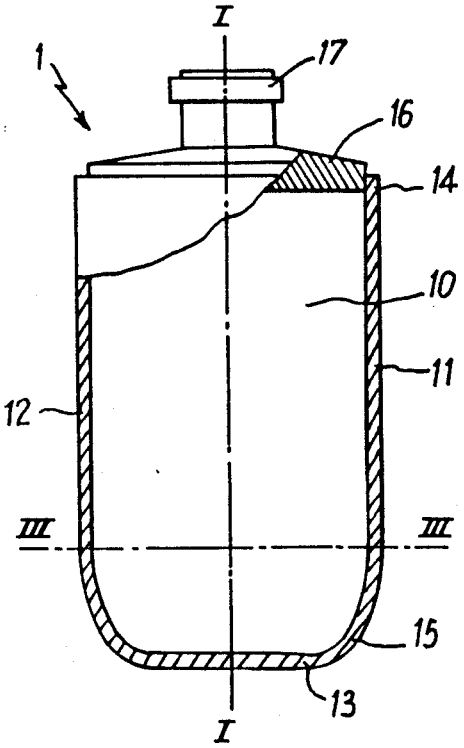

The essential point in a dispenser of the present invention is the design of its receptacle. This can clearly be seen from the description below of how a dispenser operates. To begin with a first embodiment of the receptacle is described. As shown in FIGS. 1 to 4, it is in the form of a flat tube 1. The front view of FIG. 1 shows, by virtue of its partial longitudinal section on plane II—II of FIG. 2, that the flat tube comprises an elongate envelope and a neck. The neck, also shown in the plan view of FIG. 3, comprises an elliptical base 16 surmounted by a cylindrical bottleneck 17. It is preferably molded as a single piece of relatively rigid plastic material.

In contrast, the envelope is molded in flexible material, advantageously polyethylene or polypropylene. Its top edge 14 is welded to the base 16 of the neck. Given the different sections of the base 16 and of the envelope, the edge 14 overlies the narrow portion of the neck, to some extent. This is shown in FIG. 2 which relates to the tube as manufactured.

Figure 3:
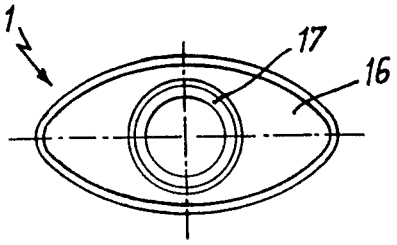
FIGS. 1 to 4 relate to a flat tube constituting a first embodiment of a resilient receptacle for a dispenser in accordance with the invention. This tube is shown in the shape it has immediately after being manufactured.
Figure 4:
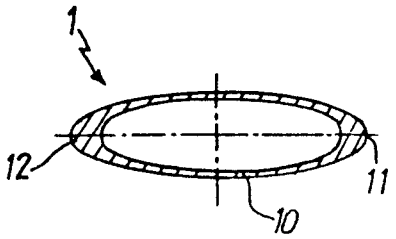
Figure 2:
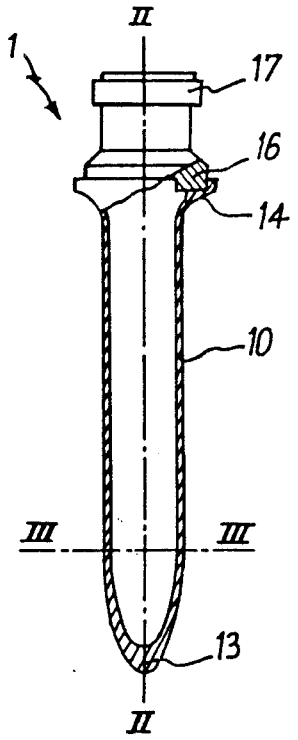

The sections on planes I—I and III—III in FIGS. 2 and 4 respectively also show the shape of the walls of the envelope. The faces 10 have relatively thin walls, thereby ensuring that they are highly flexible. In contrast, the sides 11 and 12 and the bottom 13 are stiffer by virtue of local thickening of the envelope. This reinforcement also applies to the corners 15 of the envelope which are deliberately rounded in shape.

Figure 5:
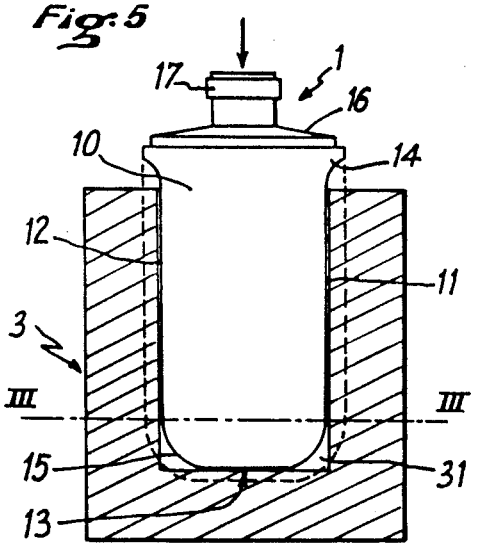
FIGS. 5 and 6 show the tube of FIGS. 1 to 4 while it is being filled, and they are respectively a front view and a cross-section on plane III—III.
Figure 6:
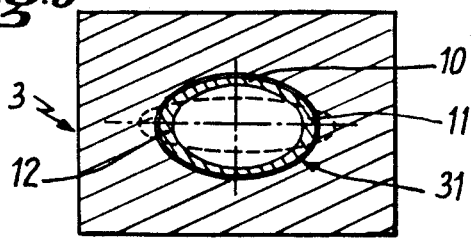

These special dispositions are explained by the way in which the tube is filled, as illustrated in FIGS. 5 and 6. During filling, the tube 1 is disposed in a rigid tube carrier 3 (e.g. made of steel). The rounded corners 15 of the envelope facilitate insertion of the envelope into the hollow 31 in the tube carrier 3. The hollow receives a length of tube 1 which is slightly shorter than the total length of the tube (see FIG. 5), and it is elliptical in section (see FIG. 6). The long axis of the ellipse is nevertheless shorter than the distance between the two sides 11 and 12 of the envelope when unstressed. When the envelope is forced into the hollow 31 of the tube carrier 3, it is deformed. The outline of the tube 1 at rest is shown by dashed lines in FIGS. 5 and 6. This shows up the change in shape imposed on the tube 1 by being inserted in the tube carrier. The section of the tube becomes more oval and closer to that of the base 16 of the neck. The overlap where the edges 14 are welded to the base therefore disappears along the faces of the envelope. However overlap now appears close to the sides 11 and 12. Overall the inside volume of the tube is considerably increased.

Figure 7:
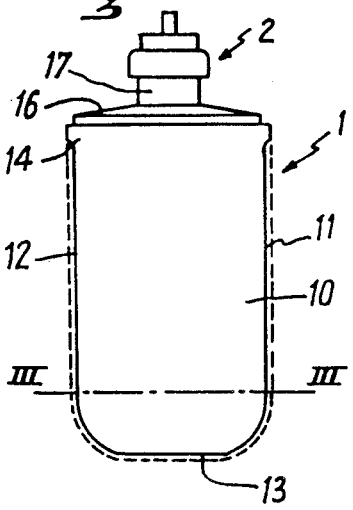
FIGS. 7 and 8 are likewise a front view and a cross-section on plane III—III respectively, showing the tube of FIGS. 1 to 6 after filling and after it has been fitted with a valve.
Figure 8:
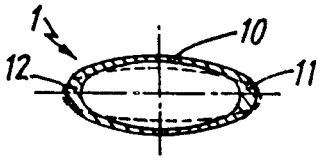
Figure 9:
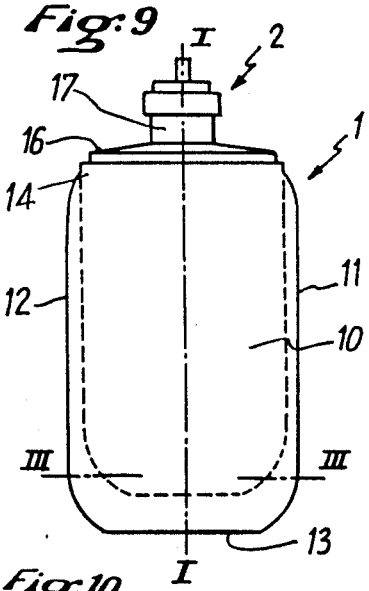
FIGS. 9 to 11 show the tube of FIGS. 1 to 8 after it has been emptied.
Figure 11:
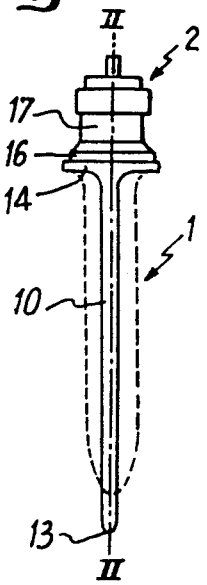
Figure 10:
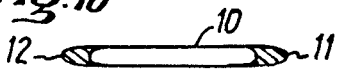

Once the tube 1 has been completely filled with substance to be dispensed, a valve 2 is crimped onto the tube in such a manner as to ensure that no air bubbles are trapped inside the tube. The valve 2 may be constituted by a simple plunger valve which, when actuated, releases a passage to the outside for the substance inside the tube. As soon as the hermetically closed tube 1 has been removed from the tube carrier 3, its resilient walls seek to return to their original shape (see FIGS. 7 and 8). Consequently, they tend to compress the substance. However, providing the substance is not very compressible, e.g. it is a liquid or a paste, its pressure increases to a pressure greater than atmospheric pressure. As a result, merely opening the valve ensures that the substance is actively expelled from the receptacle.

However, after a period of use, the quantity of substance within the tube is reduced and the tube returns little by little to its original shape (shown in dashed lines in FIGS. 5 to 11). The walls therefore cease to compress the remainder of the substance. As a result a simple open and shut valve is not suitable for completely emptying the tube. It is therefore more advantageous to use a pump type valve for the valve 2. The valve must satisfy certain operating conditions which restrict the types of valves that can be used. Valves that are designed to replace the quantity of substance dispensed by air at ambient pressure are unsuitable, as are valves whose valve member opens whenever the substance is at a pressure greater than ambient pressure. However, precompression pumps are particularly suitable. An example of such a precompression pump is described in published French patent specification number 2 305 241. Its outlet valve member opens only when the pressure inside the pump chamber exceeds a certain value preset by resilient means. In the present case, this value is selected to be greater than the maximum pressure to which the substance is subjected plus a suitable safety margin for extra pressure due to the user handling the tube. This ensures that there is no danger of the substance being ejected accidentally.

The pump begins to be genuinely useful only after sufficient substance has been dispensed for the tube to have returned to its initial shape. The pump then makes it possible to continue dispensing the substance. There is no need for a dip tube to make this work since the entire volume available inside the tube is filled with substance. This also means that substance can be dispensed from the tube regardless of the position it occupies relative to the vertical. As substance continues to be dispensed, the pressure inside the tube 1 falls below ambient. Its faces 10 therefore move towards each other and the tube ends up having the shape shown in the front view, the side view, and the cross-section of FIGS. 9, 10, and 11, respectively. By this means, it is possible to dispense between 90% and 95% of the substance initially placed in the tube 1.

Some substances, in particular pharmaceutical substances, are traditionally presented in cylindrical flasks. In order to retain this presentation with which users are presently familiar, a second embodiment of a receptacle in accordance with the invention adapts the above-described principle as applied to a flat tube to small round flasks, i.e. flasks having symmetry about an axis of revolution.

Figure 12:
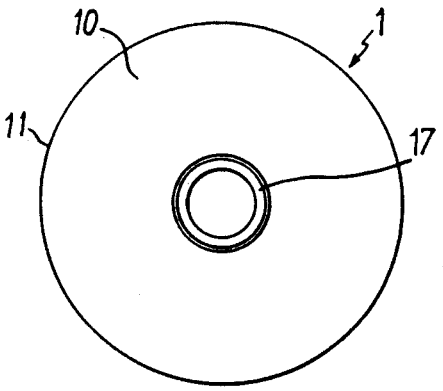
FIGS. 12 to 15 show a cylindrical flask constituting a second embodiment of a resilient receptacle for a dispenser in accordance with the present invention.
Figure 13:
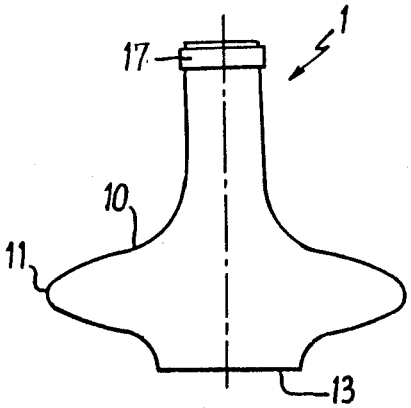

One such cylindrical flask 1 is shown immediately after manufacture in a front view in FIG. 13 and in a plan view in FIG. 12. It includes an elongate neck 17 integrally molded with a generally ovoid body. The broadest portion of the ovoid has an edge 11 which is equivalent to the sides 11 and 12 of the envelope of the flat tube. It is reinforced by greater thickness than the faces 10 of the flask body which are thinner. In addition a bottom 13 is also reinforced and allows the flask to stand upright. It also provides a bearing surface for the thumb, thereby enabling a user to manipulate the flask with one hand by passing two fingers over the top face 10 of the flask and pressing the bottom 13 with the thumb.

Figure 14:
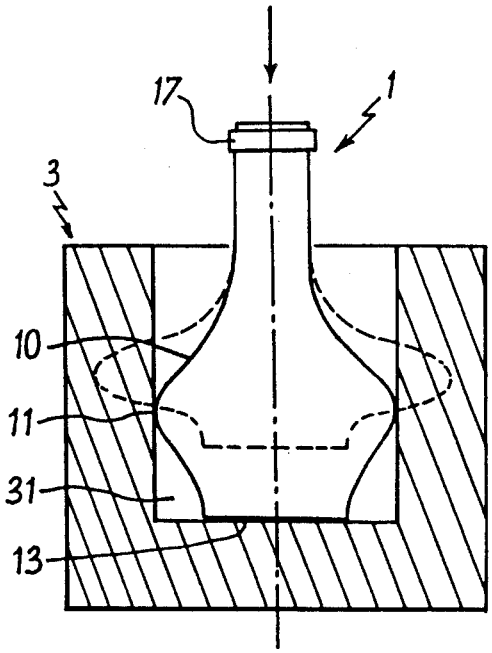

Like the flat tube, the flask is filled while it is disposed in a rigid flask carrier 3. The hollow 31 in the flask carrier 3 is cylindrical in this case, but its bore is of substantially smaller diameter than the outside diameter of the edge 11 when the flask is at rest (see dashed line in FIG. 14). As a result, once the flask has been put into place inside the hollow 31, its shape is changed in a manner made possible by the flexibility of the faces 10 of the flask. This gives rise to a considerable increase in the inside volume of the flask (e.g. the volume doubles compared with an unstressed flask).

Figure 15:
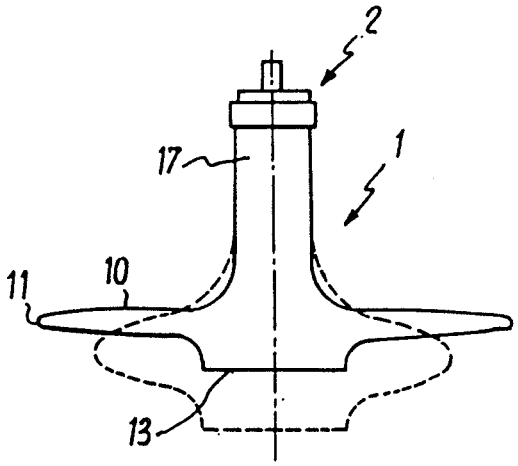

A valve 2 is crimped onto the neck 17 of the flask 1 after it has been filled to overflowing to ensure that no air is present inside the flask. As before, the valve 2 is preferably a precompression pump. As a result, the pressure inside the flask passes through three stages, as before. Initially, the walls of the flask 1 seek to return to their original shape and therefore compress the liquid or paste inside the flask. Thereafter, as the substance is dispensed, the pressure drops until the flask 1 has returned to its initial size. Finally, the pump 2 makes it possible to extract further substance and the pressure inside the flask drops below atmospheric. The flexible faces 10 move closer together as shown in FIG. 15. Since there is no dip tube, the initially ovoid body may be flattened to the greatest possible extent. If need be, the user can squeeze out the last drops from the flask by pressing against its bottom 13. This is made easier by the fact that tho flask 1 and the valve 2 constitute a spray assembly capable of operating in any position. As a result, there is little difficulty in dispensing up to 95% of the substance with which the flask was initially filled.

It should be underlined that dispensers designed in this way cannot be very large in size. They are limited by the elasticity of the receptacle. When using plastic materials that are commonly used for making receptacles, such elasticity can be guaranteed only for faces occupying relatively small areas. In addition, the conditions under which the receptacles are handled means that they must be of a size suitable for grasping. The user must be able to assist expelling the substance contained in the flask once it is no longer under pressure. As a result, a cylindrical flask in accordance with the invention will typically have a volume of 10 centiliters.

I claim:

1. A dispenser for a substance in the form of a liquid or a paste, said dispenser comprising:

a deformable receptacle operable between at least a small and a large volume configurations and being designed to rest in said small-volume configuration the inside volume of said receptacle varying as a function of its state of deformation, the operation of filling said receptacle being conducted while said receptacle is mechanically constrained in said large volume configuration sot hat, after the mechanical constraining has been removed said substance is put under pressure as a result of said receptacle seeking to return toward its rest configuration, a valve operative to close said receptacle and being suitable for ensuring that air cannot penetrate into said receptacle at any stage, wherein said deformable receptacle is designed so that the mechanical constraining necessary to put said receptacle in said large volume configuration is obtained by introducing said receptacle into a hollow formed in an undeformable part.

2. A dispenser according to claim 1, wherein said valve is a precompression pump valve.

3. A dispenser according to claim 1, wherein said receptacle is made of molded plastic material.

4. A dispenser according to claim 1, wherein said deformable receptacle is a flat tube having two flexible faces, two sides, and a bottom, said sides and said bottom being interconnected by corners, said receptacle further including a neck, said sides, said bottom, and said corners being reinforced, and said neck being constituted by a rigid base surmounted by a bottleneck.

5. A dispenser according to claim 1, wherein an envelope constituting said faces, said sides, said bottom, and said corners is welded to said base of said neck.

6. A dispenser according to claim 4, wherein said corners of said flat tube are rounded in order to facilitate insertion of said tube into said hollow of said undeformable part constituting said mechanical means.

7. A dispenser according to claim 4, wherein said hollow of said undeformable part is a cylinder of elliptical section, with the long axis of said elliptical section being shorter than the distance between said sides of said tube when said tube is at rest.

8. A dispenser according to claim 1, wherein said resilient receptacle is a cylindrical flask having an elongate neck, an ovoid body, and a bottom, said ovoid body having flexible faces interconnected by a reinforced edge, and said neck and said bottom being rigid.

9. A dispenser according to claim 8, wherein said hollow in said undeformable part is a cylinder of circular section, with the diameter of said section being less than the diameter of said edge of said flask when said flask is at rest.

* * * * *